US005782315A

United States Patent [19]

Reinosa

[11] Patent Number: 5,782,315

[45] Date of Patent: Jul. 21, 1998

[54] OIL FILTER PUMP AND AUTOMATIC METHOD FOR PRELUBRICATING AN ENGINE

[76] Inventor: Adan Reinosa, 1729 W. Moreland Dr., Montebello, Calif. 90640

[21] Appl. No.: 821,998

[22] Filed: Mar. 22, 1997

Related U.S. Application Data

[60] Provisional application No. 60/013,938, Mar. 22, 1996.

[51] Int. Cl.[6] ..... F01M 9/00

[52] U.S. Cl. ..... 184/6.3; 123/196 R; 123/196 A

[58] Field of Search ..... 184/6.3, 6.5; 123/196 S, 123/196 R

[56] References Cited

U.S. PATENT DOCUMENTS

| | | | |
|---|---|---|---|
| 4,703,727 | 11/1987 | Cannon | 123/196 S |
| 5,244,350 | 9/1993 | Yang | 184/6.3 |
| 5,310,020 | 5/1994 | Martin et al. | 184/6.3 |
| 5,589,059 | 12/1996 | Semar | 210/109 |
| 5,626,470 | 5/1997 | Gerhardt | 184/6.3 |

*Primary Examiner*—Thomas E. Denion

[57] ABSTRACT

An oil filter pump system for automatically prelubricating an internal combustion engine, uses a well known conventional oil filter design further including inlet and outlet check valves and a flexible membrane operatively connected to a prime mover. The prime mover actuates the flexible membrane back and forth from an unbiased at rest position according to an operating cycle programmed into an electronic controller. The electronic controller switches control power from the normally provided battery according to an operating cycle. The elapsed time of the operating cycle is smaller than the elapsed time for the previous prelubricating cycle to become ineffective from oil dripping from working surfaces desired to be protected from wear. The alternate movement of the flexible membrane cooperating with the inlet and outlet check valve scheme converts the conventional oil filter into an effective diaphragm pump readily connected to the normally provided engine lubricating galleries for the purpose of discharging a portion of lubricating fluid removed from the normally provided oil sump in a conventional internal combustion engine. In another embodiment, an adapter kit assembly is made to mate to a conventional oil filter by means of clamping the assembly around the conventional oil filter. A set of orifices is easily punctured in the upper wall of the conventional oil filter. An inlet and outlet check valve scheme is provided and with a prime mover alternately moving a flexible membrane in the adapter kit, converts the combination into an effective diaphragm pump. Power transmission means to the flexible membrane can be pneumatic, mechanical, electromagnetic, hydraulic, among others. According to another aspect of the invention, a method for automatically prelubricating an engine includes the steps of providing an electronic controller means coupled to a pump for automatically switching control power from the battery to the prime mover according to an operating cycle program. Programming the electronic controller with the operating cycle program which is defined as the elapsing of a first period of time added to the elapsing of a second period of time. Actuating the oil filter pump during the elapsing of the first period of time to pump and discharge the lubricating oil contained in the oil sump into the engine lubricating galleries. Thereafter, elapsing of the second period of time. And, thereafter repeating the operating cycle whereby by continuously repeating the operating cycle the engine is automatically prelubricated and primed, and protected from wear by simultaneous priming and prelubricating.

18 Claims, 5 Drawing Sheets

OIL FILTER PUMP AND AUTOMATIC METHOD FOR PRELUBRICATING AN ENGINE

Cross-Reference to: Provisional Patent Application
Application Number: 60/013,938
Filing Date: Mar. 22, 1996

BACKGROUND-FIELD OF THE INVENTION

The present invention relates to internal combustion engines, and more particularly to improvements, to a method and apparatus for admitting a lubricating fluid into the existing lubrication system of those engines for prelubricating the engine before start-up to reduce wear on the moving parts of the engine.

BACKGROUND-DESCRIPTION OF THE PRIOR ART

Internal combustion engines depend for their proper lubrication to be already running. During start-up, proper lubrication is not immediately achieved since all the oil or lubricant in the normally provided engine oil galleries is evacuated by gravity action. After the elapsing of a period of time, the oil adhered to the slidable working surfaces, engine lubricating galleries, and parts, drains to the bottom reservoir or oil sump. This leaves the slidable working surfaces unprotected from wear during the next start-up. McDonnell Douglas has performed tests which indicate that up to 90 percent of the wear in an internal combustion engine occurs during such start-ups or dry-starts due to oil starvation.

Some prior art depend for their performance on a compressed chamber of potentially flammable liquid inside a hot engine bay. Rupture of the holding chamber inside a hot engine bay will produce a fire and environmental hazard. For example, a preoiling system depicted in U.S. Pat. No. 2,736,307, which issued to Wilcox on February 1956, includes a high pressure pump for charging a reservoir with engine oil which is released by engagement of the starter switch. Another type of lubricating system, depicted in U. S. Pat. Nos. 2,755,787 and 3,422,807, releases oil from a reservoir as the ignition is activated. A preoiler with a solenoid valve is shown in U.S. Pat. No. 3,556,070 and U.S. Pat. No. 3,583,525. A valve arrangement, depicted in U.S. Pat. No. 3,583,527, which issued to Raichel on June 1971, controls the charge and discharge of a reservoir of oil under pressure in response to the closing of the ignition switch. Another engine preoiler, disclosed in U.S. Pat. No. 4,061,204, includes a valve arrangement in the base of an accumulator having multiple ports. U.S. Pat. No. 4,094,293 depicts an engine pre-oiler with a pressurized reservoir for containing engine oil. Yet another prelubrication device depicted in U.S. Pat. No. 4,112,910, shows a holding mechanism for a coiled power spring which is released on actuation of the ignition system whereupon oil in a chamber is evacuated. U.S. Pat. No. 4,359,140, which issued to J. Shreve on Nov. 16, 1982, discloses an auxiliary engine oiler including a reservoir for storing a lubricant under pressure. Another approach is U.S. Pat. No. 5,156,120, which issued to Kent on Oct. 20, 1992, discloses a system with an accumulator for holding lubricant under pressure and returning the lubricant upon engine start-up. Yet another prelubrication system, depicted in U.S. Pat. No. 4,703,727, which issued to Cannon on November 1987, shows a high pressure oil pump, controlled by an ignition switch and an oil pressure sensor, for supplying oil to an engine immediately prior to start-up. These systems introduce inconvenience, safety and potential environmental problems.

Another approach is to provide a prelubrication system such as those disclosed in U.S. Pat. Nos. 3,066,664, which issued to McNew et al. on December 1962; 3,722,623, Waldecker; 3,842,937, Lippay et al.; 4,157,744, Capriotti; 4,168,693, Harrison; 4,524,734, Miller; 4,502,431, Lulich; 4,834,039, Apostolides; 4,825,826, Andres; 4,875,551, Lulich; 4,893,598, Stasiuk; 4,936,272, Whitmore; 4,940,114, Albrecht; and 5,000,143, which issued to Brown on March 1991. Although these references partially address the problem of prelubricating the engine, there are many undesirable design drawbacks and unrecognized problems to such systems. Additional elements in prior art increase the complexity and costs of installation and maintenance of such systems, as well as the space requirements in an already cramped engine bay. Some have required original fabrication of at least some of its components. Consequently, the size, complexity, cost and problems associated with the installation and maintenance of such systems has prevented their widespread use in most vehicles. It is estimated that less than approximately 1 in 10,000 automobiles have an engine prelubrication system.

Another approach is U.S. Pat. No. 4,199,950, which issued to A. Hakanson et al. on Apr. 29, 1980, which discloses a system for prelubricating an engine during starting in the form of an atomized mist generated by a nozzle operating under high pressure conditions. U.S. Pat. No. 4,502,431, which issued to J. Lulich on Mar. 5, 1985, discloses an oil pumping system driven from the starter motor which generates oil pressure prior to start-up.

Another approach is U.S. Pat. No. 5,195,476, which issued to Schwarz on Mar. 23, 1993, discloses a system for prelubricating an engine by using the pump provided by the manufacturer as a means to pressurize the oil immediately before start-up, but at the expense of introducing undesirable wear and tear on the starting and electrical system, and inconvenience. U.S. Pat. No. 5,121,720, which issued to Roberts on June 1992, discloses a prelubrication system that operates upon the operator opening the door, with the problem of inconvenience, and unnecessary wear and tear of the apparatus due to false open door signals.

Yet another approach is found in U.S. Pat. No. 5,488,935 issued to R. L. Berry Jr. on Feb. 6, 1996, which discloses a single charge pressurized oil injection system comprising a pressure accumulator and a normally closed electromagnetic valve operated when the ignition switch is turned to the on position. Other relatively unsafe hydraulic accumulators have been provided in prior art which could be applied in the field of invention. For example, U.S. Pat. No. 2,300,722 to Adams et al. which issued on November 1942; U.S. Pat. No. 2,394,401 to Overbeke; U.S. Pat. No. 2,397,796 to Lippincott; U.S. Pat. No. 4,769,989 to Oswald et al.; U.S. Pat. No. 5,197,787 to Matsuda et al.; and U.S. Pat. No. 5,494,013 to Helbig, which issued on February 1996, are illustrative of such prior art.

One recent approach to this problem is to introduce into the engine oil chemical additives which cling to the walls of the cylinders and other movable parts after the engine is shut off. These additives have questionable effectiveness and permanency, since their effectiveness is extremely difficult, if not impossible, to ascertain or verify. In addition, booster doses are needed periodically due to degradation and oil changes. However, the present invention cooperates and enhances whatever possible benefits of this approach by delivering the treated oil to the required working surfaces. The present invention can be utilized by using the applicant's prior art invention Ser. No. 08/807,022 which teaches a method for engine prelubrication.

Each of the noted patents deals with the dry-start problem in either an incomplete or ineffective manner, unsafe, potentially dangerous by way of holding pressurized combustible material inside a hot engine bay; or by way of complex, energy intensive, and costly apparatus.

Accordingly, there has continued to be a need for a prelubricating system which is effective, simple, inexpensive to manufacture and operate, which is replaces the normally provided oil filter and therefore easily adapted to an existing engine without major modifications to the engine assembly. A system which enjoys favorable design trade-offs due to its method of operation, and more specifically benefits related to substantial reduction of size and hardware, and increased convenience.

OBJECTS AND ADVANTAGES

Accordingly, there exists a need for a prelubricating system which will reduce engine wear and will be simpler, less expensive, more space efficient, and more easily installed and maintained than prior art prelubricating systems.

It is therefore, a primary object of the present invention to provide a prelubricating system that, includes unappreciated advantages and unsuggested modifications in prior art, and which delivers unexpected additional benefits of prelubrication and priming in a novel and useful manner without the undesirable design shortcomings found in prior art.

An additional object of the present invention is to provide a prelubricating system, that includes previously unsuggested modifications which primes the internal engine lubricating galleries with lubricating oil, and that prelubricates the engine wear surfaces with lubricating oil.

An additional object of the present invention is to provide a prelubricating system, that includes a commercially available solid state timing control device, programmable controller, or programmable digital logic control element which stores or adapts an optimized pre-programmed operating strategy to maximize convenience, wear prevention functions, and to minimize system activation to increase the longevity of the system.

Yet another object of the present invention is to provide a prelubricating system, that is compact, modularly designed and manufactured from commercially available components, as a result of favorable design trade-offs, having a compact modular unit.

An additional object of the present invention is to provide a prelubricating system, that will extend the life of any engine requiring oil pressure for lubrication before start up, and could be adapted to any type of motor vehicle as an after market kit or as a full time replacement to the conventional oil filter.

A still further object of the present invention is to provide a prelubricating system, that has favorable design trade-offs and synergies, and the unrecognized advantage of a low cost of manufacture with regard to both material and labor, and which accordingly has the advantage of low price of both sale and installation to the consuming public, thereby making such engine wear prevention system economically available to the buying public.

Yet another object of the present invention is to provide a prelubricating system, that is safer and more environmentally responsible when compared to prior art which utilizes a pressurized oil accumulator in combination with an ignition switch controlled electromagnetic valve immediately prior to start-up.

A further object of the present invention is to provide a prelubricating system, that is a more easily installed engine part in an automobile assembly line due to the unappreciated advantage of its inherently smaller number of parts, readily accessible connection points, and physical size than prior art prelubrication systems.

Another object of the present invention is to provide a prelubricating system, that requires for electrical connection only one pair of wire means, and that leads to a more easily installed and safer device.

Yet another object of the present invention is to provide a prelubricating system, that is a more compact and easily installed accessory replacing the normally provided oil filter in current and older motor vehicles due to its inherently smaller number of parts, number of easily accessible connection points, and physical size than prior art prelubrication systems.

A still further object of the present invention is to provide a prelubricating system, that primes the internal lubricating galleries of said engine with lubricating oil to reduce wear by substantially reducing the time required by the engine to reach normal pressure immediately after start-up.

Yet another object of the present invention is to provide a prelubricating system, that is easily available to the buying public and through its adoption on a large scale will contribute to the enhancement of the environment by making engines run more efficiently, avoiding waste of national resources, and deferring the use of natural resources.

Further objects of the invention will appear as the description proceeds and claims drawn. To the accomplishment of the above and related objects, this invention may be embodied in the form illustrated in the accompanying drawings, attention being called to the fact, however, that the drawings are illustrative only, and that changes may be made in the specific construction illustrated and described within the scope of the appended claims.

BRIEF DESCRIPTION OF THE DRAWING FIGURES

LIST OF REFERENCE NUMERALS

Figure 1:
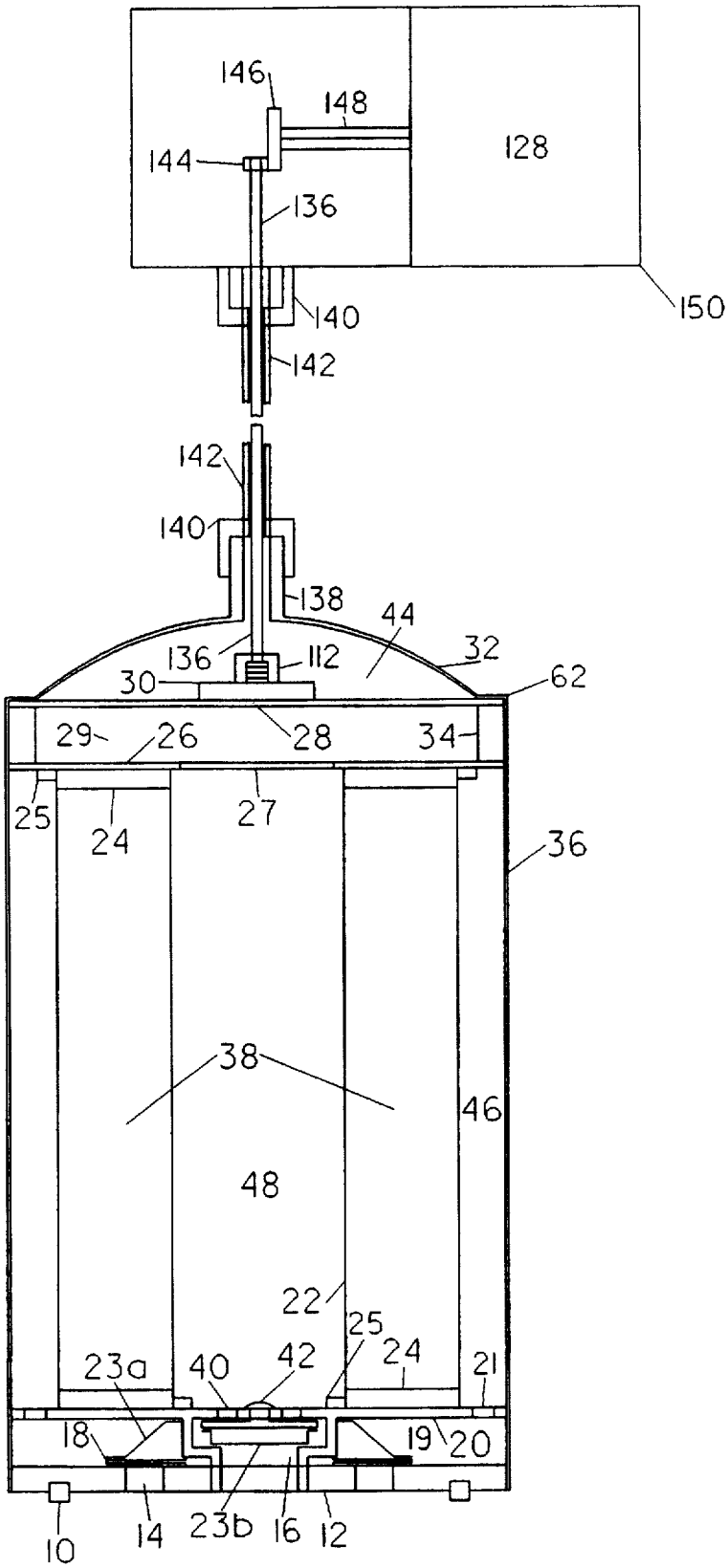
FIG. 1 is a sectional view of a preferred embodiment of the oil filter pump of the present invention.

10. Oil filter gasket.
12. Oil filter pump base plate
14. Oil filter pump inlet orifices
16. Oil filter threaded outlet orifice
18. Inlet oil filter pump check valve membrane
19. Inlet chamber
20. Bottom base support plate
21. Connecting orifices
22. Inner wall of filter element
23. Oil filter pump check valve biasing springs
24. Seal gasket 25. Oil filtering element locking blocks
26. Upper support plate
27. Orifice
28. Oil filter pump flexible diaphragm membrane
29. Pressure working chamber
30. Oil filter pump mechanical interface
32. Upper oil filter pump wall
34. Circular seal gasket
36. Oil filter sidewalls
38. Filtering medium or element
40. Oil filter pump outlet orifices
42. Oil filter pump outlet check valve membrane
44. Air pressure chamber
46. Oil filter pump cavity
48. Oil filter pump pressure chamber
49. Oil filter pump working chamber
50. Lubricating fluid
52. Engine oil pan or oil sump
53. Internal lubricating pump
54. Drain Plug
56. Engine oil pump pickup tube
58. Oil outlet tube
60. Engine block oil filter mating surface
62. Oil filter pump
65. Electromagnetic coil
66. Control wiring
68. Electronic controller
70. Duration control knob
72. Frequency control knob
74. Local control switch
75. Fusible link
76. Electric wire
77. Oil filter
78. Battery
79. Oil filter wall
80. Control wire for remote operation
82. Remote operator
84. Oil filter outlet pipe
86. Internal combustion engine
88. Engine lubricating galleries
90. Crankshaft relative motion metallic surfaces
92. Camshaft and valve train relative motion metallic surfaces
94. Hydraulic check valve
96. Modified drain plug
98. Hydraulic line or hose
100. Hydraulic disconnect coupling
101. Hydraulic coupling
108. Cable or actuating rod sheath
112. Mechanical coupler or threaded connector
114. Flexible membrane
116. Oil filter pump adapter seal kit
118. Oil filter pump adapter wall seal
120. Assembly adapter
124. Pressure chamber
126. Oil filter upper cavity
128. Prime mover power means or power source
130. Oil filter pump adapter kit sealing clamp or band
132. Oil filter pump adapter kit sealing band adjustment screw
134. Oil filter pump adapter kit housing
135. Oil filter pump adapter kit assembly
136. Reciprocating shaft
138. Oil filter pump connector
140. Oil filter pump mechanical connector
142. Mechanical guide or cable sheath
144. Eccentric attachment
146. Rotating wheel or pulley
148. Prime mover shaft
150. Prime mover

DESCRIPTION OF THE INVENTION

The description of the invention does not to seek to explain the details of well known prior of art such as an oil filter and its well known internal components, but rather the modification to such well known device resulting from the addition of an external prime mover, a flexible diaphragm, and a check valve scheme to achieve an additional novel and unexpected function.

FIG. 1 shows a cross section of a typical and well known oil filter, cylindrical in shape defined by an oil filter sidewall 36, and equipped with a flexible diaphragm membrane 28 in order to create the present invention: an oil filter pump 62. The oil filter pump 62 of the present invention mates to a conventional internal combustion engine by attaching the device to the normally provided point of attachment for the oil filter in any conventional engine. The filter pump 62 seals against the engine by a conventional circular sealing gasket or oil filter gasket 10, which is held in place by an oil filter base plate 12, which serves as the bottom supporting structure for the filter pump. Base plate 12 is provided with a plurality of inlet orifices 14 arranged in a circular pattern. Inlet orifices 14 are sealed against back flow by an inlet check valve membrane 18 and a biasing spring 23*a*. An inlet chamber 19 is defined between the base plate 12 and a bottom base support plate 20. Now referring to FIG. 1 and FIG. 2, once a lubricating fluid 50 is admitted into the filter pump 62 through inlet orifices 14 they are pushed through the base support plate 20 equipped with a plurality of connecting orifices 21 arranged in a circular pattern. Connecting orifices 21 allow for oil to discharge into a filter pump cavity 46. Filter pump cavity 46 is connected through a filtering medium or element 38 to a filter pump pressure chamber 48. Pressure chamber 48 is defined by an inner wall 22 of filter element 38 and is fluidly connected to a pressure working chamber 29 through an orifice 27 of an upper support plate 26. Filtering element 38 is sandwiched between the upper support plate 26 and bottom support plate 20 and held in place by a set of oil filtering element locking blocks 25. A pair of seal gasket 24 is also provided between the upper and lower contact surface of element 38 and plates 20 and 26 to prevent the flow of unfiltered lubricating oil to cavity 48. Pressure cavity 48 is also fluidly connected to an oil filter pump threaded outlet orifice 16 through an outlet check valve membrane 42 biased closed against a plurality of outlet orifices 40 by a biasing spring 23*b*. Lubricating fluid pressurized inside cavity 48 is forced to flow through check membrane 42 and out into the engine lubricating galleries.

Now referring to FIG. 1, the oil filter pump is shown connected to a mechanical or electric power source or prime mover 150. In the case presented in FIG. 1 a mechanical link is established between the prime mover 150 and the oil filter pump 62. In this embodiment, a power source 128 provides power to actuate a rotatably prime mover shaft, or shaft 148 which is mechanically connected to a rotating element, a wheel or a pulley 146. Pulley 146 is equipped with an eccentric attachment 144. Eccentric attachment 144 is mechanically connected to a flexible rod, cable, or reciprocating shaft 136 and provides means to convert rotary motion into reciprocating motion which is delivered and is mechanically coupled to diaphragm 28 by a threaded connector 112 which is permanently attached to diaphragm 28 through a mechanical interface 30. A circular seal gasket 34 is provided to seal chamber 29 from an air pressure chamber 44. Reciprocating shaft 136 is surrounded by a channel guide, or cable sheath 142. Cable sheath 142 guides and protects reciprocating shaft 136 and connects to oil filter pump 62 by a mechanical connector 140 screwed or attached around an oil filter pump connector 138. Shaft 136 is connected by a permanently attached threaded connector 112 to diaphragm 28. Diaphragm 28 defines the volume of pressure chamber 29, which in turn is connected through orifice 27 in upper support plate 26 to pressure chamber 48. Diaphragm 28 also defines the air pressure chamber 44 between the volume defined by diaphragm 28 and an upper oil filter pump wall 32. Pressure chamber 48 is also connected to threaded outlet 16 of oil filter pump 62 through outlet membrane 42 opening and through outlet orifices 40.

Figure 2:
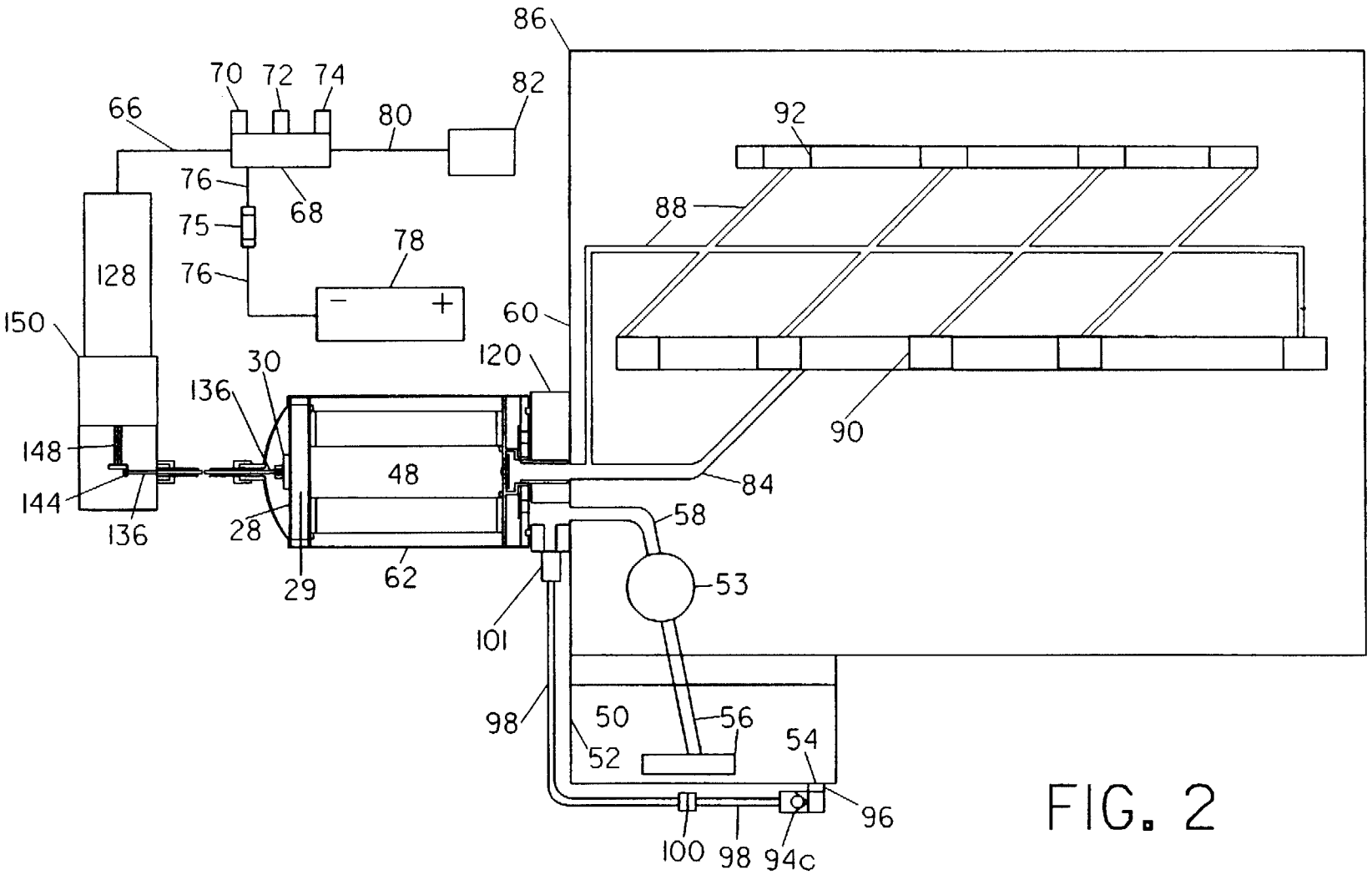
FIG. 2 is a schematic representation of the preferred embodiment with all auxiliary components and connected to a typical internal combustion engine.

Referring now to the drawings, FIG. 2 shows an schematic and a system description of all the parts comprising the oil filter pump system prelubricating apparatus attached to an schematic of a typical gasoline, diesel engine block, or internal combustion engine 86. Still referring to FIG. 2, oil filter pump 62 is connected to the normally provided point of connection of the conventional engine oil filter. The oil filter pump 62 of the present invention is connected to an assembly adapter 120. Adapter 120 mates to a normally provided engine block oil filter mating surface 60. Adapter 120 is connected to a hose 98 through a hydraulic coupling 101. Hose 98 is connected to a hydraulic disconnect coupling 100. Disconnect coupling 100 is connected through a second section of hose 98 to a check valve 94c which prevents oil back flow. A modified drainplug 96 having a center channel is provided to allow lubricating fluid 50 to be evacuated from an oil sump 52 and may substitute or connect to a normally provided drain plug 54. The lubricating fluid 50 will lubricate a plurality of working areas and surfaces such as crankshaft relative motion metallic surfaces 90 and a plurality of camshaft and valve train relative motion metallic surfaces 92 of the internal combustion engine 86. Inlet check valve membrane 18 and outlet check valve membrane 42 cooperate with flexible diaphragm membrane 28 to effectively convert the conventional oil filter into a diaphragm pump. When prime mover 150 urges membrane 28 away from its unbiased at rest position to increase the internal volume defined by the enclosure, the oil filter 62 will behave as a diaphragm pump in suction mode. When prime mover 150 urges membrane 28 away from its unbiased at rest position to decrease the internal volume defined by the enclosure, the oil filter 62 will behave as a diaphragm pump in discharge mode. The check valve scheme is used to facilitate retention of oil inside the oil filter to facilitate priming and obviously does not have to be located in the filter but can also be located at a remote location in the equivalent hydraulic circuit. The oil filter pump 62 can even do without adapter 120, by allowing hydraulic access through a properly dimensioned sidewall coupling mating with hydraulic coupling 101 in hose 98. The present invention can be utilized by using the applicant's prior art invention Ser. No. 08/807,022 with the use of an electronic controller 68.

Electronic controller 68 controls the pumping action of the redesigned oil filter to deliver lubricating fluid 50 for a preset duration and frequency into engine lubricating galleries 88 to maintain internal working parts substantially lubricated at all times. This method disclosed in applicant's prior art Ser. No. 08/807,022 and cooperating with the present invention will provide substantial lubrication of the working areas prior to engine 86 start-up and will continue to prevent wear during and immediately after, but before a normally internal lubricating pump 53 operation. It will facilitate priming since statistically an engine oil pump pickup tube 56 will be the only part not primed by the present invention. Flow through a normally provided oil outlet tube 58 is prevented since mechanical tolerances in pump 53 are generally tight.

Still referring to FIG. 2, oil filter pump 62 is controlled by electronic controller 68. Electronic controller 68 is well known and is commercially available in customized form from many manufacturers. Controller 68 specified functions are:

- Electronic controller 68 with a duration control knob 70 which allows for controlling and adjusting pump 62 duration of operation, which is proportional to volume of lubricating fluid 50 delivered through the normally provided engine lubricating galleries 88.
- Electronic controller 68 with a frequency control knob 72 which allows for controlling and adjusting oil filter pump frequency or periodic operation, which is proportional to amount of remaining lubricating fluid 50 still in the lubricating galleries 88, and which frequency period is smaller than the time required for oil 50 to evacuate galleries 88 and working surfaces 90 and 92 due to gravity action.
- Electronic controller 68 which allows manual local operation by including a local control switch 74 and remote operation by a remote operator 82 through a control wire for remote operation 80.
- Electronic controller 68 which allows for routing power for oil filter pump operation from electric power source or battery 78.
- Electronic controller protected by a fusible link 75 in series with an electric wire 76 interconnected with battery 78 for preventing electric overload conditions, and to limit short circuit damage
- Electronic controller 68 which ceases all operation if a preset low voltage level is achieved for the purposes of avoiding total discharge of battery 78

Still referring to FIG. 2, the controlling signals from electronic controller 68 are routed to prime mover 150, which will provide the means to urge the perpendicular motion to flexible diaphragm 28. The coupling can be magnetic, mechanical, hydraulic, pneumatic, or the like. However coupling means are used, the oil filter pump will operate according to the control settings of electronic controller 68. Upon oil filter pump operation, lubricating fluid 50 will be taken from inlet of oil filter pump 62 and pressurize the lubricating fluid 50 to be delivered to filter cavity 46. The charge of lubricating fluid 50 will be pushed through filtering material 38 and into pressure chamber 48 and through threaded outlet 16 at outlet of oil filter pump. Once charge of lubricating fluid 50 moves through the oil filter pump 62 and delivered through threaded outlet 16 of the present invention, the charge of lubricating fluid 50 is directly injected into the engine lubricating galleries 88 of engine 86.

Referring still to FIG. 2, the charge of lubricating fluid 50 suctioned by the system, and then pressurized by the oil filter pump 62 is made to flow in a conventional manner into the lubricating galleries 88 of a conventional and typical internal combustion engine 86. It can be seen that the charge of lubricating fluid 50 made to flow through the lubricating galleries 88 will be distributed and delivered to various working areas of engine 86. In this process, the charge of oil 50 will impregnate engine 86 internal parts and crankshaft working areas 90 and camshaft and valve train working areas 92.

The charging cycle of oil or lubricating fluid 50 controlled by 68, and as long as there is power in battery 78, and no loss of engine 86 oil supply, the lubrication system will perform as a closed system. It is obvious the on-demand operation is also possible by activating the filter pump through the remote operator 82 which could be a commercially available push button switch or a keyless remote wireless control.

Figure 3:
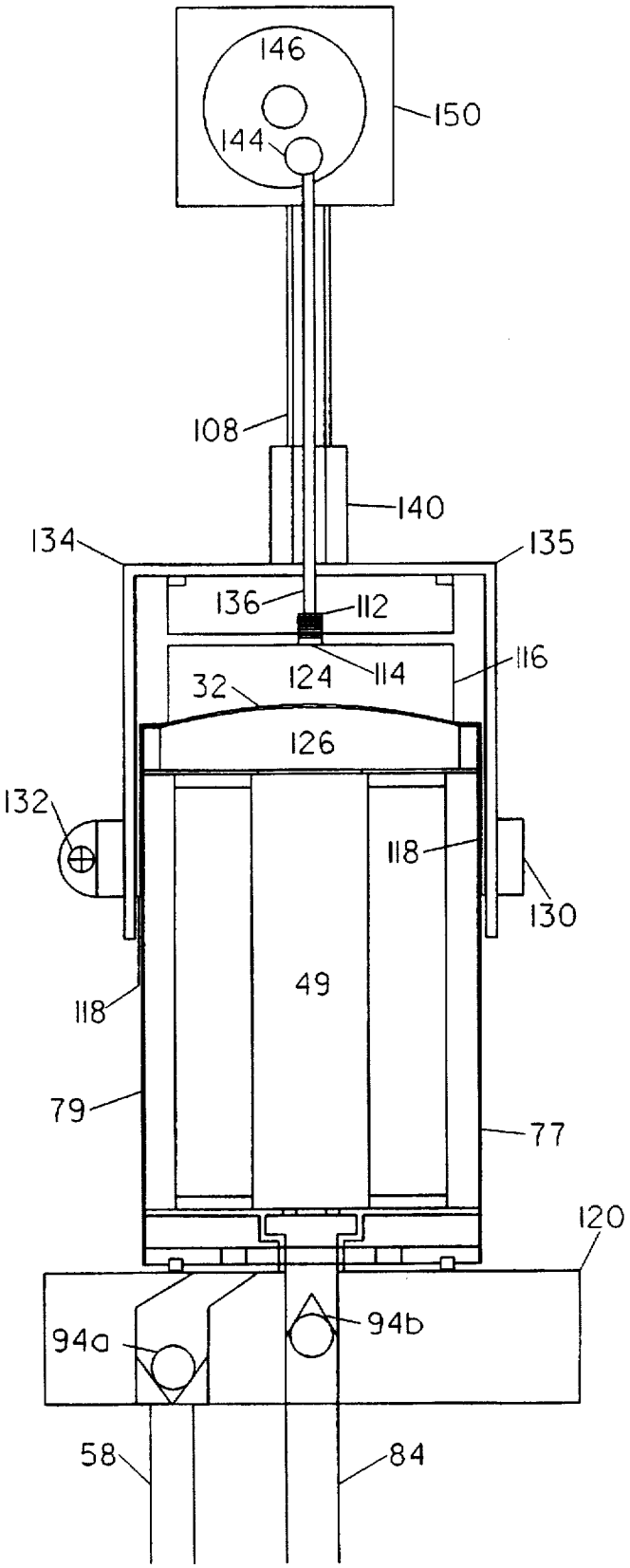
FIG. 3 is a sectional view of a second embodiment showing a conventional oil filter fitted with an oil filter pump adapter kit assembly of the present invention.
Figure 4:
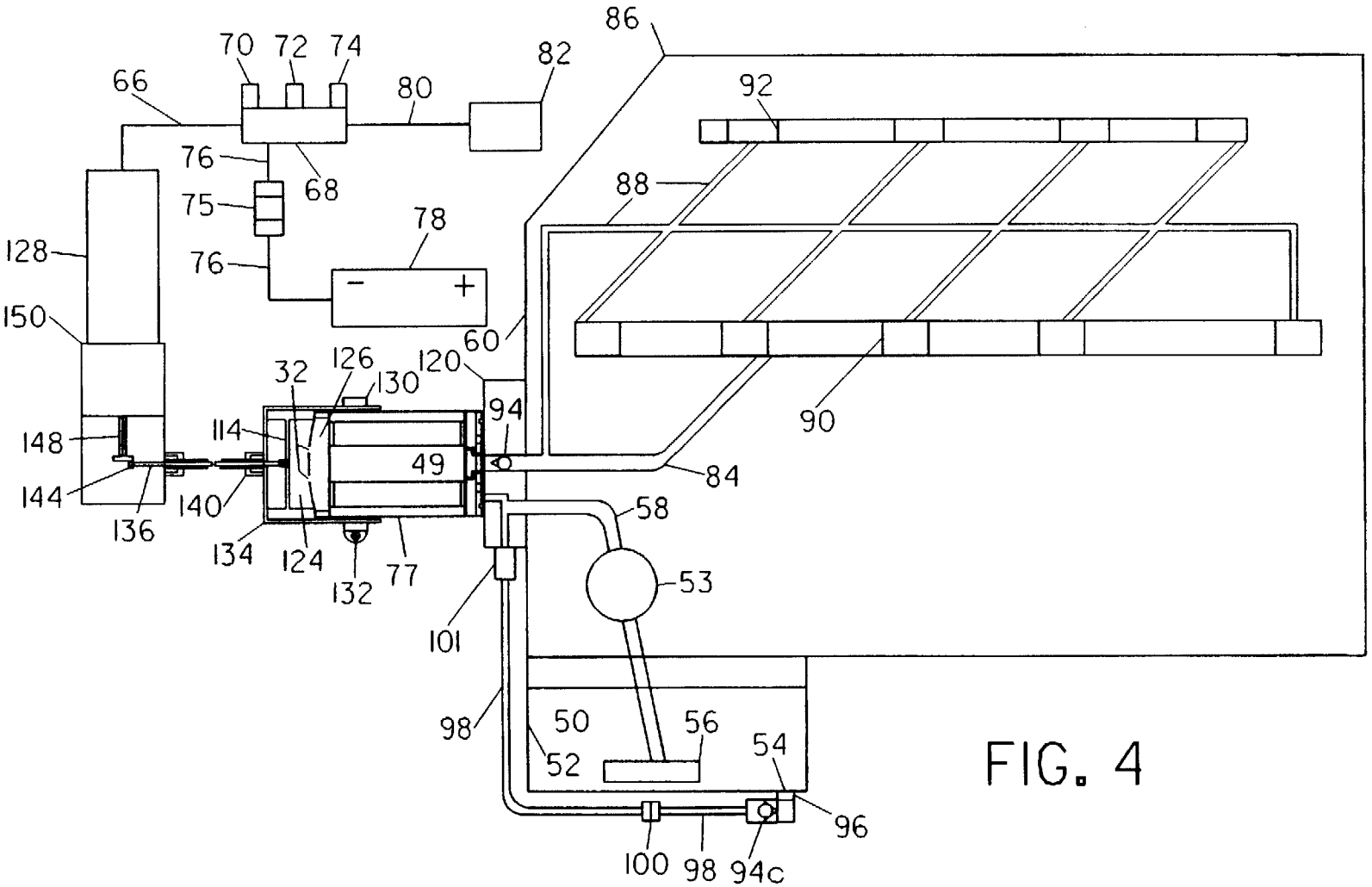
FIG. 4 is a schematic representation of the second embodiment with all necessary auxiliary components and connected to a typical internal combustion engine.

A second embodiment of the present invention is shown in FIG. 3. The same theory of operation is employed in this embodiment. Here, this embodiment departs from the preferred by attaching external hardware to a conventional oil filter 77. Such additional hardware converts the conventional oil filter 77 into a device which lubricates the engine according to the theory of operation of the preferred embodiment. This embodiment consists of an adapter kit assembly 135 which attaches to an ordinary and conventional oil filter. The mechanical driver or prime mover 150 can be coupled by many means of power transmission such as the reciprocating shaft 136 enclosed by a actuating rod sheath 108. Now referring to FIG. 4 shows a typical illustration of the second embodiment. Engine manufacturers provided generous space around the conventional disposable oil filter. Therefore, enough room is provided to fit the adapter kit to the conventional oil filter. Now referring to FIG. 3, the oil filter pump adapter kit assembly 135 must have a matching sealing surface to the engine. This will be achieved by the adapter 120. Adapter 120 is equipped with an inlet check valve and an outlet check valve **94*a* and 94*b* respectively which function is needed to leave a sufficient priming volume inside the oil filter pump and as an integral function needed to convert the conventional oil filter into an effective diaphragm pump. It is also obvious that check valves 94*a* and 94*b* can be remotely located from adapter 120 but in the same operational position in the hydraulic circuit. By incorporating the adapter 120** with check valve scheme, fitting the adapter kit and by puncturing a few small holes in the top surface of the conventional oil filter, the conventional oil filter is now converted into an effective diaphragm pump.

Now referring to FIG. 4, by urging a perpendicular motion to a flexible membrane 114 inside an adapter kit housing 134, attached around an oil filter wall 79 held in place by an oil filter pump adapter kit sealing clamp or band 130, the oil filter now can deliver a volume of oil or lubricating fluid 50 into the normally supplied lubricating galleries in a conventional manner. An oil filter pump adapter kit sealing band adjustment screw 132 is used to attach housing 134 around filter wall 79. An adapter wall seal 118 is provided to avoid leaks from a pressure chamber 124. An oil filter pump adapter seal kit 116 is also provided to avoid lubricating fluid 50 to leak from pressure chamber 124. Pressure chamber 124 is fluidly connected to an oil filter upper cavity 126 by puncturing the upper filter wall 32 of filter 77 with a plurality of orifices. Oil filter pump assembly 135 will pressurize lubricating fluid 50 in an oil filter pump working chamber 49 and deliver it through outlet check valve 94b and through an outlet pipe 84 and into the conventionally provided engine lubricating galleries 88. In this way, this embodiment continues to operate as in the preferred embodiment. Control power for assembly 135 can be obtained in similar fashion as the preferred embodiment through magnetic coupling, mechanical coupling, or conceivably a solenoid internal to a built up replacement filter.

Now referring to FIG. 4, electronic controller 68 will establish the same operating pattern as the preferred embodiment with regards to pump mode operation. This compact assembly will deliver the desired lubricating characteristics of the preferred embodiment, resulting in prelubrication of engine 86 crankshaft working surfaces 90 and camshaft and valve train working surfaces 92.

Figure 5:
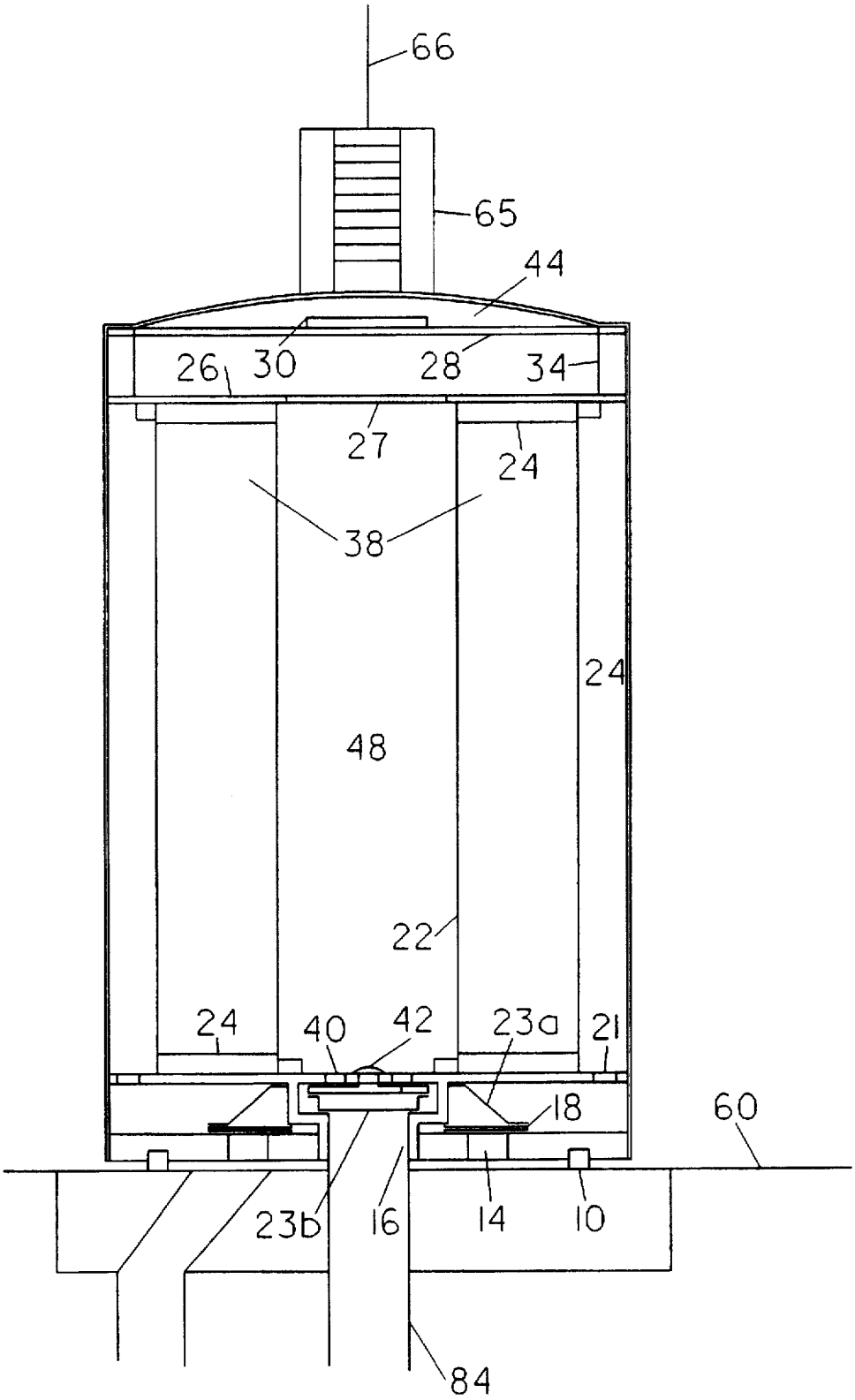
FIG. 5 is a sectional view of a third embodiment showing an electromagnetic mechanical coupling.

Referring to FIG.2 and FIG. 5, electronic controller 68 could be electrically or mechanically connected to oil filter pump 62 through a wire harness or control wiring 66 if the mechanical coupling at the oil filter pump is electromagnetic such as an electromagnetic coil 65, or if it is mechanically coupled then it may be a cable or the like such as in the case of FIG. 1 and FIG. 3. Power driving means or reciprocating shaft 136 can be electric wire, hydraulic, pneumatic, mechanical couplings such as cable or flexible shaft, or similar power transmission means depending on the choice for motive power.

It will be understood that each of the elements described above, or two or more together may also find a useful application in other types of methods differing from the type described above, and that some of the well known parts of a conventional well known oil filter have been omitted for the purpose of clarity.

While certain novel features of this invention have been shown and described and will be pointed out in future claims, it is not intended to be limited to the details above, since it will be understood that various omissions, modifications, substitutions and changes in the forms and details of the device illustrated and in its operation can be made by those skilled in the art without departing in any way from the spirit of the present invention.

I claim:

1. An oil filter pump system replacing a normally provided oil filter and attached to a normally provided point of connection in an internal combustion engine for prelubricating a set of normally provided engine galleries, said engine having an oil sump containing a lubricating fluid, a battery, a normally provided oil filter point of attachment on said engine, comprising:

a rigid enclosure containing a filter element, and further including a flexible membrane coupled by power transmission means to a prime mover to urge said flexible membrane to change an internal volume defined by said rigid enclosure and said flexible membrane in its unbiased at rest position;

an inlet check valve means to allow lubricating fluid flow into said internal volume;

an outlet check valve means to allow lubricating fluid flow out of said internal volume;

a conduit means for fluidly connecting said inlet check valve means to said oil sump to remove a portion of said lubricating oil while said flexible membrane is urged by said prime mover to increase said internal volume;

an oil filter pump outlet orifice to allow for attachment of said oil filter pump to said oil filter normally provided point of attachment on said engine to fluidly connect to said engine oil galleries to discharge said portion of lubricating fluid while said flexible membrane is urged by said prime mover to decrease said internal volume; and an electronic controller means coupled to said battery for automatically switching control power to said prime mover.

2. The oil filter pump system of claim 1, wherein said conduit means includes a hydraulic disconnect coupling.

3. The oil filter pump system of claim 1, further comprising a remote operator operatively connected to said electronic controller means to activate said oil filter pump remotely.

4. The oil filter pump system of claim 1, further comprising a fusible link interconnected with said battery for preventing electric overload conditions.

5. The oil filter pump system of claim 1, further comprising a modified drain plug having a center channel to allow lubricating oil from said oil sump to flow into said oil filter pump.

6. The oil filter pump system of claim 1, further including an assembly adapter sandwiched between said oil filter pump and said normally provided oil filter point of attachment on said engine to facilitate connection of said oil filter pump to said engine.

7. An oil filter pump system attached to a normally provided oil filter on an internal combustion engine for prelubricating a set of normally provided engine galleries, said engine having an oil sump containing a lubricating fluid, a battery, comprising:

a rigid enclosure dimensioned as a cylinder in cross section to mate to a conventional oil filter which is shaped as a cylinder in cross section, said enclosure including a flexible membrane coupled by power transmission means to a prime mover to urge said flexible membrane to change an internal volume defined by said rigid enclosure and said flexible membrane in its unbiased at rest position;

a normally provided upper oil filter wall equipped with a plurality of orifices to fluidly connect said rigid enclosure to said conventional oil filter internal volume;

an inlet check valve means to allow lubricating fluid flow into said internal volume; an outlet check valve means to allow lubricating fluid flow out of said internal volume;

a conduit means for fluidly connecting said inlet check valve means to said oil sump to remove a portion of said lubricating oil while said flexible membrane is urged by said prime mover to increase said internal volume;

a normally provided threaded point of attachment of a conventional oil filter to discharge said portion of lubricating fluid into said engine galleries while said flexible membrane is urged by said prime mover to decrease said internal volume; and an electronic controller means coupled to said battery for automatically switching control power to said prime mover.

8. The oil filter pump system of claim 7, wherein said conduit means includes a hydraulic disconnect coupling.

9. The oil filter pump system of claim 7, further comprising a remote operator operatively connected to said electronic controller means to activate said oil filter pump remotely.

10. The oil filter pump system of claim 7, further comprising a fusible link interconnected with said battery for preventing electric overload conditions.

11. The oil filter pump system of claim 7, further comprising a modified drain plug having a center channel to allow lubricating oil from said oil sump to flow into said oil filter pump.

12. The oil filter pump system of claim 7, further comprising an assembly adapter sandwiched between said conventional oil filter and said normally provided oil filter point of attachment on said engine to facilitate location of said inlet and outlet check valve means.

13. An oil filter pump system replacing a normally provided oil filter and attached to a normally provided point of connection in an internal combustion engine for prelubricating a set of normally provided engine galleries, said engine having an oil sump containing a lubricating fluid, a battery, a normally provided oil filter point of attachment on said engine, comprising:

a rigid enclosure containing within a set of conventional and well known components of a conventional oil filter, and further including a flexible membrane coupled by electromagnetic power transmission means to a prime mover to urge said flexible membrane to change an internal volume defined by said rigid enclosure and said flexible membrane in its unbiased at rest position;

an inlet check valve means to allow lubricating fluid flow into said internal volume; an outlet check valve means to allow lubricating fluid flow out of said internal volume;

a conduit means for fluidly connecting said inlet check valve means to said oil sump to remove a portion of said lubricating oil while said flexible membrane is urged by said prime mover to increase said internal volume;

an oil filter pump outlet orifice to allow for attachment of said oil filter pump to said oil filter normally provided point of attachment on said engine to fluidly connect to said engine oil galleries to discharge said portion of lubricating fluid while said flexible membrane is urged by said prime mover to decrease said internal volume; and an electronic controller means coupled to said battery for automatically switching control power to said prime mover.

14. The oil filter pump system of claim 13, wherein said conduit means includes a hydraulic disconnect coupling.

15. The oil filter pump system of claim 13, further comprising a remote operator operatively connected to said electronic controller means to activate said oil filter pump remotely.

16. The oil filter pump system of claim 13, further comprising a fusible link interconnected with said battery for preventing electric overload conditions.

17. The oil filter pump system of claim 13, further comprising a modified drain plug having a center channel to allow lubricating oil from said oil sump to flow into said oil filter pump.

18. The oil filter pump system of claim 13, further including an assembly adapter sandwiched between said oil filter pump and said normally provided oil filter point of attachment on said engine to facilitate connection of said oil filter pump to said engine.

* * * * *